United States Patent [19]

Breslin

[11] Patent Number: 5,050,264

[45] Date of Patent: Sep. 24, 1991

[54] UNIVERSAL AIRFLOW VACUUM CLEANER MODULE

[75] Inventor: John J. Breslin, Los Altos, Calif.

[73] Assignee: Beamco, Inc., Mountain View, Calif.

[21] Appl. No.: 510,210

[22] Filed: Apr. 16, 1990

[51] Int. Cl.[5] ..... A47L 5/36

[52] U.S. Cl. ..... 15/327.1; 15/314; 15/327.2

[58] Field of Search ..... 15/314, 327.1, 327.2, 15/327.6

[56] References Cited

U.S. PATENT DOCUMENTS

| | | | |
|---|---|---|---|
| 3,240,000 | 3/1966 | Hayes et al. | 15/314 X |
| 3,308,609 | 3/1967 | McCulloch et al. | 15/327.1 X |
| 3,618,297 | 11/1971 | Hamrick | 15/314 X |
| 3,910,781 | 10/1975 | Bryant | 15/314 X |
| 4,185,974 | 1/1980 | Hiester | 15/327.6 X |
| 4,355,434 | 10/1982 | Gongwer | 15/327.1 |
| 4,783,878 | 11/1988 | McCambridge | 15/327.6 |

*Primary Examiner*—Chris K. Moore

*Attorney, Agent, or Firm*—Limbach, Limbach & Sutton

[57] ABSTRACT

A module adapted to be used as and an end or intermediate plate for a canister-type vacuum cleaner. The module comprises a disk-shaped body having a plurality of closed peripheral recesses which may be used to mount components to the body, or opened to form passages through the body. A groove is formed in the body to the interior to the peripheral recesses to receive and provide for the positioning of a baffle relative to the plate. In the preferred embodiment the groove is circular and the plate has a closed central recess formed centrally of the recess, which central recess may be opened to form a passage through the body.

13 Claims, 1 Drawing Sheet

UNIVERSAL AIRFLOW VACUUM CLEANER MODULE

BACKGROUND OF THE INVENTION

The present invention relates to a universal module which may be used to form an end or separator plate in a canister type vacuum cleaner and, more particularly, is directed to such a module which has closed recesses formed therein which may be used for mounting components, or opened to provide flow passages.

Prior vacuum cleaners generally have end plates and separator plates which are specially designed and fabricated to be used for a single purpose only. For example, a top end plate would be designed to provide air passages to the interior of the vacuum cleaner and for the mounting of a blower; a bottom end plate would be designed to close the bottom of the vacuum cleaner and provide for the mounting of casters; and a separator plate would be provided to provide a baffle within the cleaner. Each plate would be unique and could only serve the purpose for which it is designed. The plates were not interchangeable. As a result, special tooling and attendant expense was required for the manufacture of each of the plates and, necessarily, an inventory of a plurality of different types of plates needed to be maintained by the manufacturer of the cleaner.

SUMMARY OF THE INVENTION

The module of the present invention comprises a disk-shaped body having a plurality of closed peripheral recesses formed therein at spaced intervals and a groove formed centrally of the body to the interior of the recesses. The recesses are capable of being opened to form passages through the body. The groove is adapted to receive and locate a baffle relative to the plate. In the preferred embodiment, the groove is circular and concentric with the body and a closed central recess is formed in the body within the confines of and concentric with the groove.

A principal object of the invention is to provide a universal module which may be used as an end or separator plate in a canister-type vacuum cleaner.

Another object of the invention is to provide such a module which may be used either as the top or bottom end plate of a canister-type vacuum cleaner.

Still another object of the invention is to provide such a module with universal recesses which may be maintained in a closed condition, or opened to provide airflow passages.

Yet another object related to the latter object is to provide such a module wherein the recesses may be used to mount component parts to the vacuum cleaner.

A further object of the invention is to provide such a module which is formed with a groove to receive and provide for the positioning of a baffle relative to the module.

Still another object of the invention is to provide such a module having a peripheral flange which may be used to secure and position the module relative to a cylindrical housing.

These and other objects will become more apparent when viewed in light of the following detailed description and accompanying drawings.

DESCRIPTION OF THE PREFERRED EMBODIMENT

Figure 1:
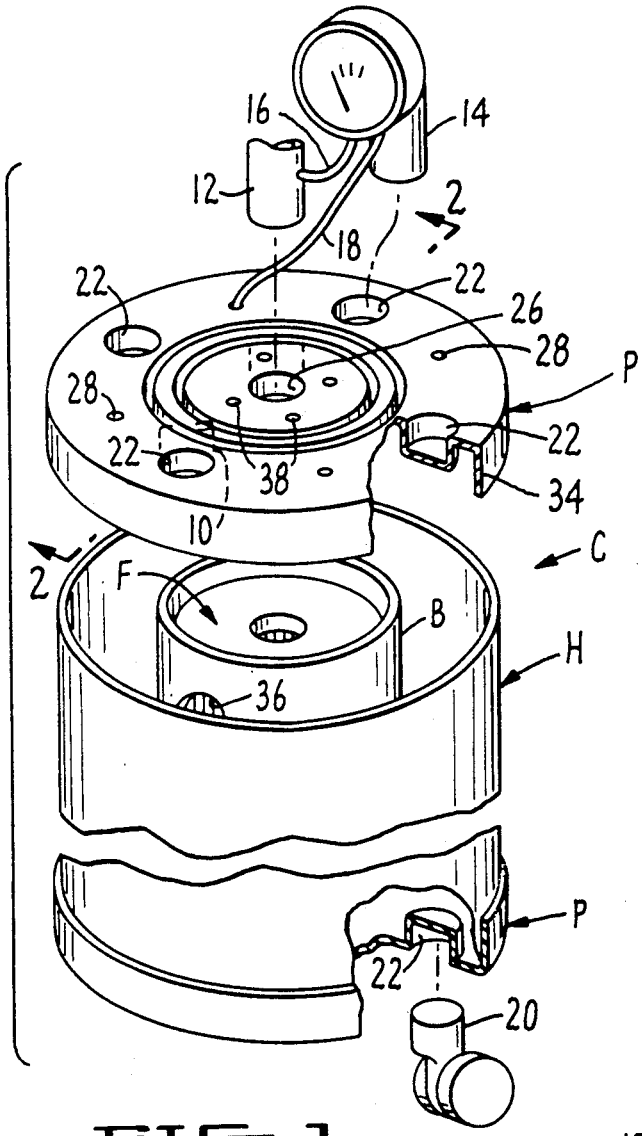
FIG. 1 is an exploded perspective view of a canister-type vacuum cleaner having top and bottom end plates which are provided by identical modules constructed according to the present invention.

Referring now to FIG. 1, the canister-type vacuum cleaner there illustrated is designated in its entirety by the letter "C" and comprises: an outside housing "H" provided by an open ended cylinder; end plates "P" at either end of the housing; a baffle "B" concentrically received within the housing and held in place by the end plates "P"; a filter cartridge "F" received within the baffle "B"; a vacuum inlet line 10 extending through the periphery of the top end plate "P"; a vacuum discharge line 12 extending through the center of the top end plate "P" and into the filter cartridge "F"; a vacuum gauge 14 mounted to the top end plate "P" and having pressure lines 16 and 18 connected to the interior of the line 12 and the interior of the housing "H", respectively; and casters 20 mounted to the bottom end plate "P".

The universal module of the present invention provides the end plates "P" of the illustrated vacuum cleaner. Each module comprises a disk-shaped body having a plurality of large peripheral recesses 22 formed therein at spaced intervals; an annular groove 24 concentric with the body; a central recess 26 within the confines of and concentric with the groove 24; a plurality of small closed peripheral recesses 28; a plurality of small closed central recesses 30; and, a peripheral flange 34. As initially fabricated, all of the recesses within the plates "P" are closed. To adapt the plate "P" for use as a top plate as shown in FIG. 1, one of the large peripheral recesses 22 is opened to accommodate the inlet line 10 and the central recess 26 is opened to accommodate the discharge line 12. One of the small peripheral recesses 28 is also opened to accommodate connection of the pressure line 18.

A bottom end plate "P" corresponds in construction to the top place, except that none of the recesses formed therein are opened. Cylindrical mounting lugs on the casters 20 are received within the large peripheral recesses 22 of the bottom end plate "P". The recesses 22, in effect, serve as mounting fixtures for the casters.

Figure 2:
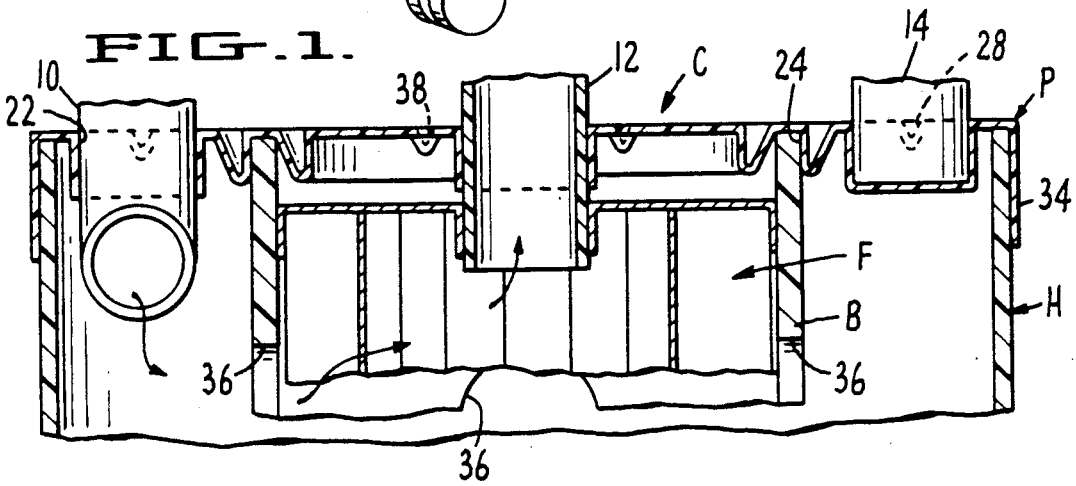
FIG. 2 is a cross-sectional view taken on the plane designated by Line 2—2 of FIG. 1; and, FIG. 3 is a cross-sectional elevational view, with parts thereof broken away, showing how two modules constructed according to the present invention may be engaged surface-to-surface to provide a separator plate within a canister-type vacuum cleaner.

In the assembled condition of the vacuum cleaner "C" shown in FIG. 1, the baffle "B" is located between and captured by the grooves 24 in the top and bottom end plates (see FIG. 2). Openings 36 in the wall of the baffle "B" provide for the flow of air from the inlet line 10 through the filter "F" and out the discharge line 12. The discharge line 12 is connected to a suitable vacuum source. The end plates assume sealed engagement with respect to the open top and bottom edges of the housing "H". The flanges 34 on the end plates engage around the exterior of the housing and concentrically locate the plates relative to the housing.

The vacuum gauge 14 is mounted to the cleaner by engagement of a mounting lug on the gauge within one of large peripheral recesses 22. The gauge senses the inlet pressure of the vacuum cleaner through the line 18 and the outlet pressure of the vacuum cleaner through the line 16.

Figure 3:
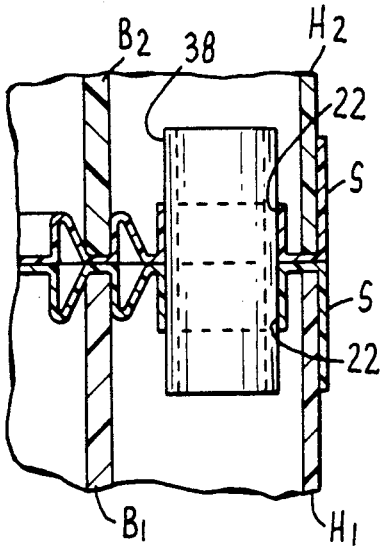

FIG. 3 illustrates two of the universal modules of the invention, corresponding to the plates "P", mounted in face to face relationship to provide a separator plate within a vacuum cleaner housing. As there shown, the components are designated separator plates "S". The lower plate "S" is engaged over a housing "$H_1$" and a baffle "$B_1$" in the same manner that the top plate "P" is engaged over the housing "H" and the baffle "B". The top separator plate "S" is inverted relative to the lower plate so as to have face to face contact therewith. A housing "$H_2$" and baffle "$B_2$" are engaged with the top plate "S". The plates "S" are so arranged that the peripheral recesses therein are aligned. As shown in FIG. 3, aligned recesses 22 have been opened and a cylindrical conduit 38 has been extended therethrough to establish fluid communication between the interior of the housings "$H_1$" and "$H_2$".

From FIG. 3 it will be apparent that the outside surfaces of the plates "S" fall within planes which may engage in surface to surface contact. No protruding parts extend from these surfaces. Protrusions, such as the recesses, grooves, and flanges all extend from the inside surfaces of the plates.

The modules of the present invention may be fabricated of any suitable material, such as a copolymer, steel or aluminum. In one exemplary embodiment the material is vacuum formed ABS having a thickness of approximately $\frac{1}{8}$ inch. In that embodiment, the outside diameter of the plate is 15 inches, the large recesses have a 2 inch internal diameter, the small recesses have a 5/16 inch inside diameter, and the groove 24 has an outside diameter of 8-$\frac{5}{8}$ inches and an inside diameter of 8-$\frac{1}{4}$ inches. It should be appreciated that these dimensions and the material of the exemplary embodiment are but one example of a plate constructed according to the present invention.

Conclusion

While a preferred embodiment of the invention has been illustrated and described, it should be appreciated that the invention is not limited to the specifics of this embodiment, but rather is defined by the accompanying claims.

I claim:

1. A universal module for use as an end or separator plate in a canister type vacuum cleaner, said module comprising:

(a) a disk-shaped body having a plurality of closed peripheral recesses formed therein at spaced intervals, said recesses being capable of being opened to form passages through the body; and, (b) a groove formed generally centrally of the body to the interior of the recesses, said groove being adapted to receive and locate a baffle relative to the module.

2. A module according to claim 1 further comprising a closed central recess formed in the body to the interior of the peripheral recesses, said central recess being capable of being opened to form a passage through the body.

3. A module according to claim 2 wherein the groove is circular and concentric with the body.

4. A module according to claim 3 wherein the central recess is within the confines of and concentric with the groove.

5. A module according to claim 1 further comprising a peripheral flange formed around the body.

6. A module according to claim 5 wherein:

(a) the body has outside and inside surfaces and the outside surface defines a plane with no parts of the plate extending to the outside thereof;

(b) the flange extends from the inside surface of the body.

7. A module according to claim 1 wherein the peripheral recesses are of varying cross-section, with at least certain of said peripheral recesses being sufficiently large to provide a vacuum cleaning inlet or outlet and other of said peripheral recesses being sufficiently small to provide for the connection of vacuum gauge lines to the module.

8. A module according to claim 1 wherein at least certain of the peripheral recesses may be maintained in a closed condition and used as fixtures for the mounting of component on the module.

9. A universal module for use as an end or separator plate in a canister type vacuum cleaner, said module comprising:

(a) a disk-shaped body having a plurality of closed peripheral recesses formed therein at spaced intervals, said recesses being capable of being opened to form passages through the body; and, (b) a closed central recess formed in the body to the interior of the peripheral recesses, said central recess being capable of being opened to form a passage through the body.

10. A module according to claim 9 further comprising a peripheral flange formed around the body.

11. A module according to claim 10 wherein:

(a) the body has outside and inside surfaces and the outside surface defines a plane with no parts of the plate extending to the outside thereof;

(b) the flange extends from the inside surface of the body.

12. A module according to claim 9 wherein the peripheral recesses are of varying cross-section, with at least certain of said peripheral recesses being sufficiently large to provide a vacuum cleaning inlet or outlet and other of said peripheral recesses being sufficiently small to provide for the connection of vacuum gauge lines to the module.

13. A module according to claim 9 wherein at least certain of the peripheral recesses may be maintained in a closed condition and used as fixtures for the mounting of components on the module.

* * * * *